US011545805B2

(12) United States Patent
Linde

(10) Patent No.: US 11,545,805 B2
(45) Date of Patent: Jan. 3, 2023

(54) METHOD FOR PRODUCING A CONNECTING DEVICE

(71) Applicant: Airbus Operations GmbH, Hamburg (DE)

(72) Inventor: Peter Linde, Hamburg (DE)

(73) Assignee: Airbus Operations GmbH

( * ) Notice: Subject to any disclaimer, the term of this patent is extended or adjusted under 35 U.S.C. 154(b) by 743 days.

(21) Appl. No.: 16/521,778

(22) Filed: Jul. 25, 2019

(65) Prior Publication Data

US 2020/0044405 A1 Feb. 6, 2020

(30) Foreign Application Priority Data

Jul. 31, 2018 (DE) ..... 10 2018 118 479.4

(51) Int. Cl.
*H01R 43/20* (2006.01)
*H01R 12/78* (2011.01)
*H01R 13/627* (2006.01)

(52) U.S. Cl.
CPC ..... *H01R 43/205* (2013.01); *H01R 12/78* (2013.01); *H01R 13/6273* (2013.01)

(58) Field of Classification Search
CPC ... H01R 13/6273; H01R 12/78; H01R 43/205
USPC ..... 29/876, 874, 825, 592.1
See application file for complete search history.

(56) References Cited

U.S. PATENT DOCUMENTS 3,278,887 A 10/1966 Travis
3,404,454 A * 10/1968 Sayles ..... H02G 1/1287 264/254
5,233,753 A 8/1993 Wolf et al.
8,393,918 B2 3/2013 Cheng et al.

FOREIGN PATENT DOCUMENTS

DE 4036592 A1 5/1992
WO 2004040708 A1 5/2004

OTHER PUBLICATIONS

German Search Report for Application No. DE 102018118479.4 dated Jul. 2, 2019, (p. 2 categorizing the cited references).

* cited by examiner

*Primary Examiner* — Peter Dungba Vo
*Assistant Examiner* — Azm A Parvez
(74) *Attorney, Agent, or Firm* — Lerner, David, Littenberg, Krumholz & Mentlik, LLP

(57) ABSTRACT

A method for producing a connecting device for connecting films with conductor tracks includes the steps of laying a first film with conductor tracks onto a forming die, applying a first lower shell of a plastic material onto a first end portion of the forming die, producing a cut-out and shifting the first film so that the cut-out lies completely on the first lower shell, applying upper conductor tracks of a conductive material onto the first lower shell so that the upper conductor tracks overlap with the conductor tracks of the first film, and applying a first upper shell of a plastic material onto the first lower shell so that the first film, the first lower shell and the first upper shell connect together by substance bonding to form a first connector. In this way, an integral connector can be provided on each film.

12 Claims, 5 Drawing Sheets

METHOD FOR PRODUCING A CONNECTING DEVICE

FIELD OF THE INVENTION

The invention concerns a method for producing a connecting device, a line system with such a connecting device, and an aircraft with at least one equipment component which is equipped with such a line system.

BACKGROUND TO THE INVENTION

Electrical lines which are printed directly onto components or films connected thereto are found in large numbers in modern aircraft construction. These can easily be exchanged for upgrading. The weight of such a solution is significantly lower than that of a conventional cable. Areas of application include instrument panels or trim elements in motor vehicles. Using the technology, at least some cable connections can be omitted.

For example, DE 40 36 592 A1 describes a flexible circuit on a flexible plastic film carrier, wherein the electrical circuit is configured in the form of a metal layer only a few microns thick.

BRIEF SUMMARY OF THE INVENTION

It may be useful to apply such technology in aircraft construction and apply lines for example directly onto trim components or use printed films. The prior art contains only relatively bulky connections for connecting such printed lines, which are not particularly suitable for use in commercial aircraft.

Consequently, aspects of the invention propose a connecting device and a method for producing a connecting device which allows particularly simple manufacturing and which provides a connecting device which is as compact, robust and reliable as possible.

A method is proposed for producing a connecting device for connecting films with conductor tracks, wherein the method comprises the steps of laying a first film with a first arrangement of conductor tracks onto a first portion of a forming die, applying a first lower shell of a plastic material onto a first end portion of the forming die adjoining the first portion, producing a cut-out open towards the first end portion on the first film, shifting the first film so that the cut-out lies completely on the first lower shell, applying upper conductor tracks of a metallic material onto the first lower shell so that the upper conductor tracks overlap with the conductor tracks of the first film, and applying a first upper shell of a plastic material onto the first lower shell so that the first film, the first lower shell and the first upper shell connect together by substance bonding to form a first connector.

The forming die constitutes primarily a supporting surface for receiving the first film and the second film. The first portion of the forming die may in particular be a flat portion which receives the first film in a flat arrangement. A first end portion may be at least partially offset to the first portion so that a spacing exists between an extension plane of the first portion and—at least partially—an extension plane of the first end portion, which spacing can receive a first lower shell of a plastic material.

Firstly, a first film is applied to the first portion of the forming die. Preferably, the first film is arranged such that it does not cover the first end portion but at most adjoins this. The first film may be a material which may comprise polyethylene, polypropylene, polyvinyl chloride, polyamide, polyalkylene and polyarylene terephthalate, polysulphone, polyphenylene sulphide, polycarbonate and polyimide. It may be suitable to use a film of a material which is used for production of circuit boards, such as a polyester, polycarbonate or polyimide.

The first film may have an arrangement of conductor tracks which may comprise a metallic material. This may e.g. be a mixture of a hardenable plastic and metal particles embedded therein. Alternatively, particles could also be used which are based on carbon allotropes and have an adequate electrical conductivity.

The first lower shell of a plastic material may be applied in a subsequent or in a preceding step. The lower shell is a component which forms part of a push-fit connector which will be positioned on one side of the first film. The width of the lower shell is adapted to the first arrangement of conductor tracks. The totality of conductor tracks should have a width which is smaller than the width of the first lower shell.

In order to connect the first film to the lower shell later, firstly the cut-out is made in the first film. This is open towards the first end portion. Preferably, the surface extension of the cut-out is smaller than the surface extension of the first lower shell so that it lies completely on the first lower shell. For example, the open cut-out may be formed as a rectangle. It is preferred that the cut-out extends up to the conductor tracks. Preferably, this may be produced such that the cut-out covers a surface region which originally contained conductor tracks.

The cut-out may be produced by various ways. These include the use of a mechanical or physical cutting device. The physical cutting device may in particular be laser-based so that a cut-out can be produced by vaporisation of a contour of the film material.

By shifting the first film such that the open cut-out lies completely on the first lower shell, a connection can be made both mechanically and electrically. For this, firstly upper conductor tracks of a conductive material are applied to the first lower shell so that the upper conductor tracks overlap with the conductor tracks of the first film. The overlap creates the electrical connection between the upper conductor tracks and the conductor tracks of the first film. At the same time, the conductor tracks are arranged on the first lower shell so that the conductor tracks of the first film can be connected electrically towards the outside via the first lower shell.

Then the first upper shell of a plastic material is applied to the first lower shell so that the first film, the first lower shell and the first upper shell connect together by substance bonding to form a first connector. Consequently, the cut-out with the upper conductor tracks and the overlapping region of the conductor tracks is completely encapsulated between the first lower shell and the first upper shell and constitutes a first electrical connector. The plastic material of the first lower shell and the first upper shell may be matched to each other so that a secure, substance-bonded connection can be created.

The method may furthermore comprise the step of laying a second film with a second arrangement of conductor tracks on a second portion of the forming die, applying a second lower shell of a plastic material onto a second end portion of the forming die adjoining the second portion, producing a cut-out open towards the second end portion on the second film, shifting the second film so that the cut-out lies completely on the second lower shell, applying upper conductor tracks of a conductive material onto the second lower shell so that the upper conductor tracks overlap with the conductor tracks of the second film, and applying a second upper shell of a plastic material onto the second lower shell so that the second film, the second lower shell and the second upper shell connect together by substance bonding to form a second connector, which is formed so as to be complementary to the first connector such that the first connector and the second connector can be connected together mechanically and electrically. Accordingly, a second connector with a second film can be produced which is complementary to the first connector. This could take place on a common forming die using the same devices, so that a precise correlation is possible.

In an advantageous embodiment, the application of the lower shell and/or the upper shell may comprise the performance of an additive layer manufacturing process. The additive layer manufacturing process (ALM) can very easily produce a component with an arbitrary spatial geometry. Use of the process leads to the layered production of a physical component with relatively arbitrarily complex form. The material properties may be equivalent or superior to those of a casting. The material used defines the method of output of the material. It is conceivable that a molten material is applied in layers.

As already mentioned initially, the cut-out preferably has a smaller surface extension than the first lower shell. Because of the smaller surface extension, it is possible for the cut-out to be laid completely onto the first lower shell, so that all edges of the cut-out are covered or surrounded by plastic material and the cut-out can be completely filled with plastic material. This gives a particularly secure and solid connection.

Preferably, the cut-out is formed to be rectangular and has a smaller width and smaller depth than the first lower shell. Production of the cut-out is consequently particularly simple and may be achieved with various tools. The design of the cut-out is also very simple, and all conductor tracks protruding into the cut-out have the same distance from an end edge of the cut-out. Consequently, all upper conductor tracks are designed identically.

The method may furthermore comprise the step of producing at least one opening with a contour which is spaced from the edges of the first film. This may improve the connection to the lower shell and the respective upper shell. The opening may in particular be circular and have a surface extension which is significantly smaller than the surface extension of the cut-out.

In an advantageous embodiment, the production of at least one opening comprises the production of at least two openings which are adjacent to two mutually opposing edges of the cut-out. Accordingly, a preferably symmetrical arrangement of at least two openings on either side of the cut-out is produced, which significantly improves a power transmission.

The application of upper conductor tracks may comprise the performance of an additive layer manufacturing process. The additive application of conductor tracks allows an electrical connection to be created easily on the forming die.

The application of the lower shell and/or the upper shell may comprise the integration of at least one latching means. The latching means is provided to form a latching connection with a corresponding connector. It may be provided that both a lower shell and an associated upper shell have a respective latching means. Alternatively, only one of the lower shell and upper shell may have such a latching means.

The application of the upper conductor tracks may comprise the production of a contact portion to form a connection with another contact portion. The contact portion is provided for creating an electrical connection with another contact portion. This could e.g. belong to a corresponding connector. The contact portion could be configured in various ways and in particular may impose a defined superficial contact between the two contact portions when there is a mechanical contact of the two connectors.

The first lower shell and the first upper shell may form a protrusion at which the upper conductor tracks of the first film end. Accordingly, a type of plug connector may thus be formed.

The second lower shell and the second upper shell may enclose a recess into which the protrusion can be inserted and in which the upper conductor tracks of the second film end. Accordingly, a type of socket may thus be formed.

The invention furthermore comprises a line system with a first film and a second film which each comprise conductor tracks, wherein the first film is equipped with a first connector and the second film is equipped with a second connector, wherein the respective lower shell and the respective upper shell comprise a plastic material and are connected by substance bonding to the respective film, wherein upper conductor tracks are arranged which overlap the conductor tracks of the respective film, and wherein the first connector and the second connector are designed to be complementary to each other. Accordingly, the invention also concerns a line system with a first film and a second film each equipped with a connector which can be connected to the respective other connector.

Preferably, the first connector has a protrusion and the second connector preferably has a recess in which the protrusion can be inserted, so that a mechanical and electrical connection is produced.

The invention furthermore concerns an aircraft comprising at least one equipment component which is equipped with such a line system.

BRIEF DESCRIPTION OF THE DRAWINGS

Further features, advantages and possible applications of the present invention arise from the following description of the exemplary embodiments and from the figures. All features described and/or shown in the figures, alone and in arbitrary combination, form the subject of the invention, irrespective of their combination in the individual claims or back references. In the figures, the same reference signs designate the same or similar objects.

DETAILED DESCRIPTION

The following FIGS. 1 to 10 show individual working steps of the method according to an aspect of the invention. At the same time, suitable tools are shown which may execute the method according to an aspect of the invention.

Figure 1:
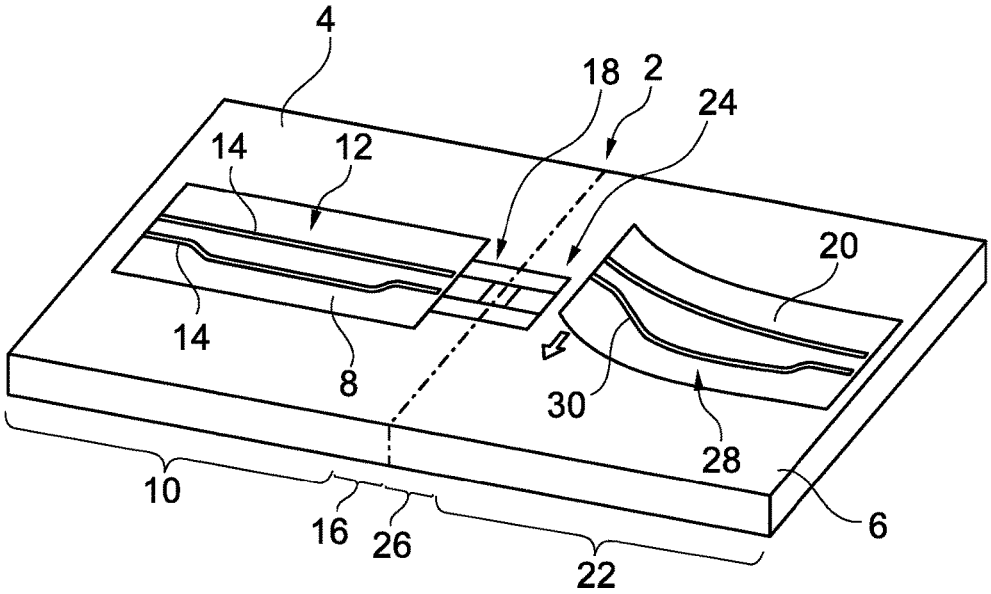
FIGS. 1 to 10 show individual working steps for performance of the method according to an aspect of the invention.

FIG. 1 shows a forming die 2 with the first forming die half 4 and a second forming die half 6, which for example are laid flush against each other. In the further figures, for the sake of simplicity, only the first forming die half 4 is depicted. Method steps executed thereon may also be executed similarly on the second forming die half 6.

Firstly, a first film 8 is laid on a first portion 10 of the forming die 2, wherein the first film 8 has an arrangement 12 of conductor tracks 14. A first end portion 16 of the forming die 2 however remains free. Here, a first device 18 is arranged for producing a depression, as will be explained in more detail in the following figures. The first film 8 adjoins this first device 18.

Furthermore, a second film 20 is laid on a second portion 22 of the forming die 2 and adjoins a second device 24 for producing a depression, which is arranged in the second end portion 26. The second film 20 has a second arrangement 28 of conductor tracks 30 which are to be connected to the conductor tracks 14 on the first film 8.

Figure 2:
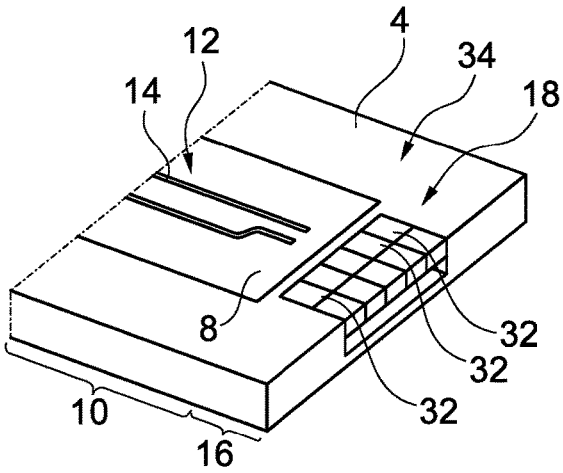
Figure 3:
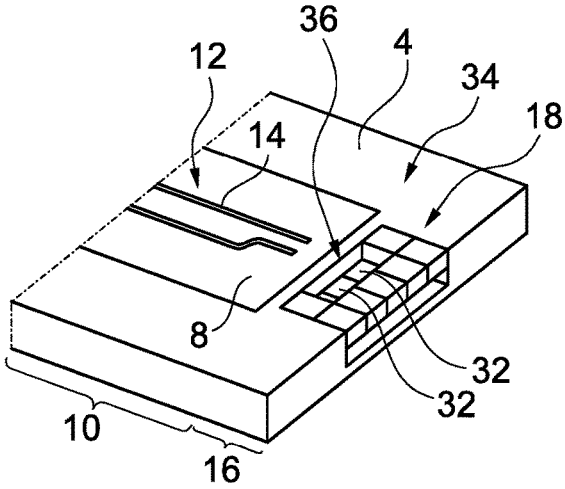

FIG. 2 shows, in a slightly enlarged view, the first forming die half 4 with the first film 8 arranged thereon and adjoining the first end portion 16. The first device 18 for producing a depression comprises compressible or retractable elements 32 which are movable in a direction perpendicular to an extension plane of the first film 8 or a first surface 34. In this way, a defined depression 36 can be produced, as shown in FIG. 3. It should be noted here that the depression 36 does not extend over the entire first end portion 16 but merely over a partial portion.

Figure 4:
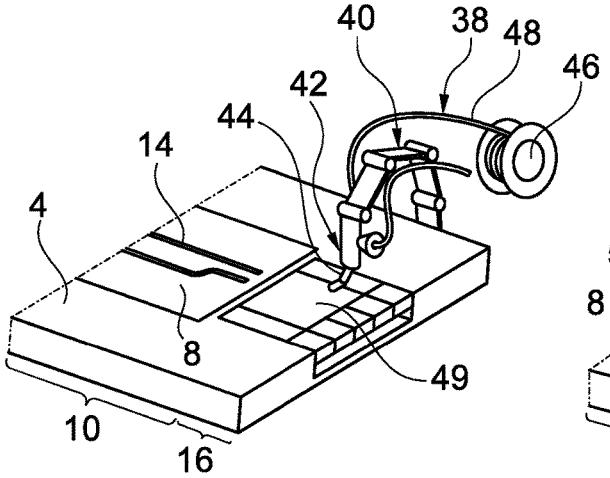

FIG. 4 shows a first device 38 for applying a plastic material in the depression 36. As an example, a robot arm 40 is used here which, at a free end 42, is provided with a delivery device 44 which can conduct plastic into the depression 36. The plastic could for example be provided on a coil 46 in the form of a strip-like plastic material 48 which is heated in the delivery head 44 and conducted into the depression 36 in liquid or paste form. Individual strips may be deposited by the robot arm 40, which are arranged parallel to each other or in a specific pattern. The aim is to fill the depression 36 completely with the plastic material and thereby produce a first lower shell 49.

Figure 5:
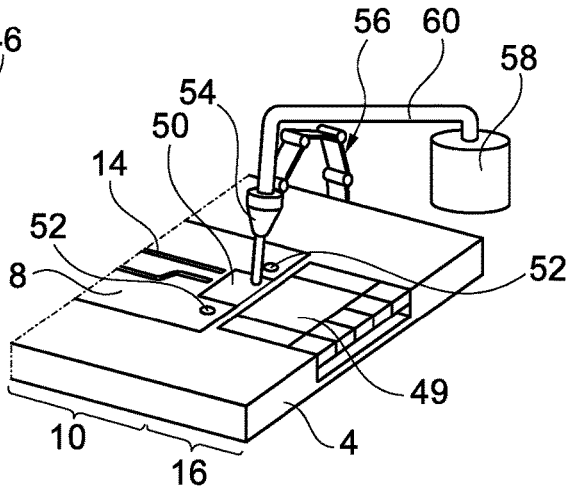

As FIG. 5 shows, a cut-out 50 is then produced in the first film 8. The cut-out is for example rectangular and open towards the first end portion 16. Adjacent to this, two openings 52 are arranged which are spaced from the cut-out 50. For example, the arrangement of cut-out 50 and openings 52 is symmetrical. For example, the cut-out and the openings 52 are produced by a physical cutting device 54 implemented in the form of a laser cutting device arranged on a robot arm 56. This could comprise an external laser 58 which is guided to an exit lens via optical fibres 60. The robot arm 56 may be the same robot arm as the robot arm 40 shown in FIG. 4.

Figure 6:
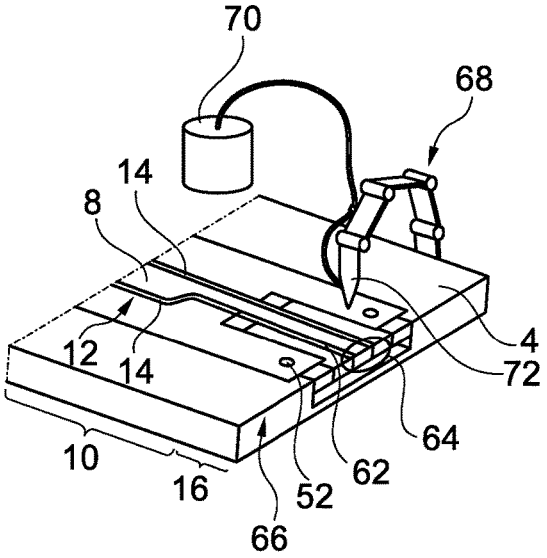

As FIG. 6 shows, the first film 8 is shifted onto the depression 36 so that the cut-out 50 lies completely on the depression 36 or on the first lower shell 49. Then upper conductor tracks 62 of a conductive material are applied to the first lower shell 49 so that they substantially completely cover the first end portion 16 and overlap at least in regions with the conductor tracks 14 of the first film 8. The upper conductor tracks 62 consequently complement the conductor tracks 14 of the first film 8 in order to create a contact portion 64.

It is noted here that the first film 8 does not completely cover the entire first end portion 16 but has a spacing from an end edge 66 of the first end portion 16, which means that the upper conductor tracks 62 are configured such that their contact portion 64 extends from the first film 8. The application of the upper conductor tracks 62 may take place by an additive process. For this, another robot arm 68 is shown which may correspond to the robot arm 40 or the robot arm 56. A store 70 for providing a conductive material is here connected with a delivery head 72 which applies the conductive material in layers onto the lower shell. This material may for example comprise a meltable plastic or a hardenable binder with conductive particles contained therein.

Figure 7:
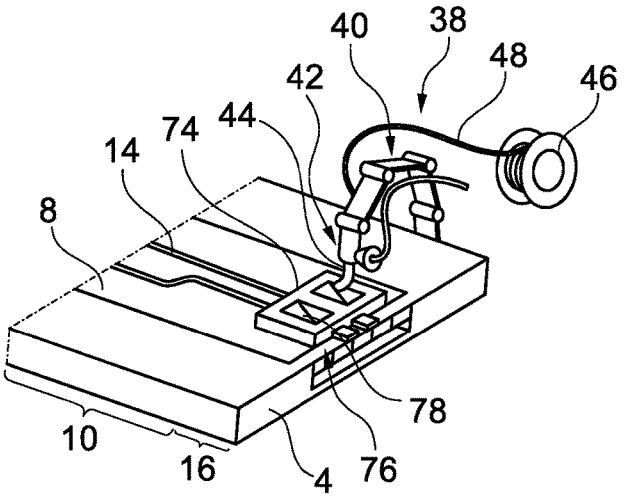

As shown in FIG. 7, then the device 38 may apply a first upper shell 74 which is oriented and formed so as to correspond to the lower shell. In this way, the first film 8, the conductor tracks 14 and 62, and the lower shell form an integral first connector 76. For example, latching means 78 are arranged on a side of the first upper shell 74 facing away from the first film 8.

Figure 8:
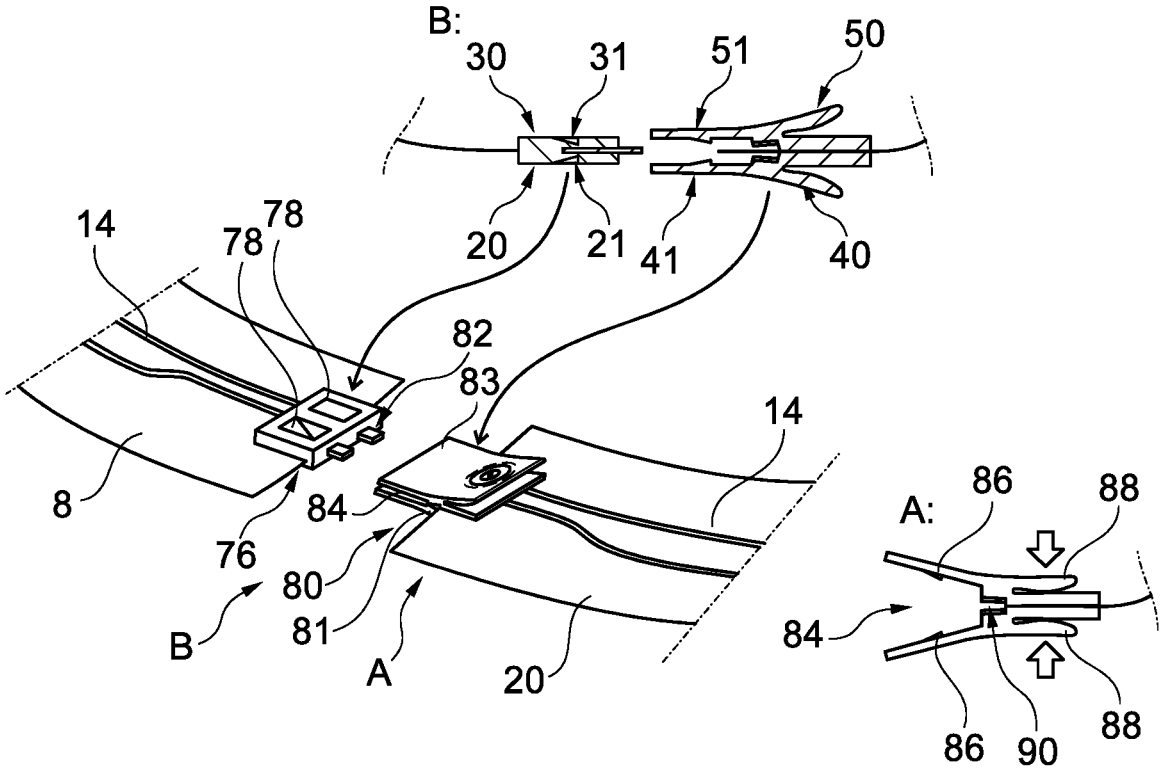

FIG. 8 shows that the forming die 2 may also be used to produce a second connector 80 which is integrally connected to the second film 20. Accordingly, a second lower shell 81 and a second upper shell 83 are formed here. The first connector 76 and the second connector 80 are designed to be complementary to each other. Whereas the first connector 76 has a protrusion 82, the second connector 80 has a depression 84.

Also, the individual partial depictions, for example detail depiction A, show that latching means 86 are also arranged in the depression 84 and correspond to the latching means 78 of the first connector 76. The second connector 80 also has tabs 88 which face away from each other and are arranged on a side facing away from the recess 84, and which can be gripped and pressed in the manner of pincers in order to enlarge the recess 84, move the latching means 86 apart, and release a connection to the first connector 76.

Furthermore, an upper conductor track 90 can be seen on an inner end of the recess 84, which may come into contact with the first contact portion 64. Accordingly, this is a second contact portion 90 corresponding thereto.

Figure 9:
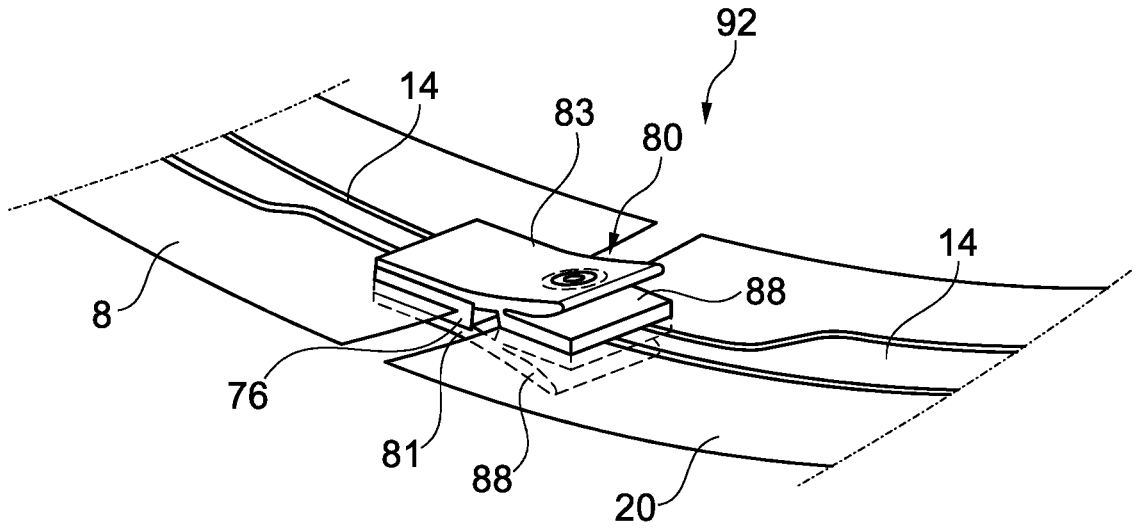

FIG. 9 shows the first connector 76 and a second connector 80 which create a mechanical and electrical connection. It is evident that the second connector 80 is configured such that it completely covers the first connector 76. The two films 8 and 20, with their conductor tracks 14 and connectors 76 and 80, form a line system 92.

Figure 10:
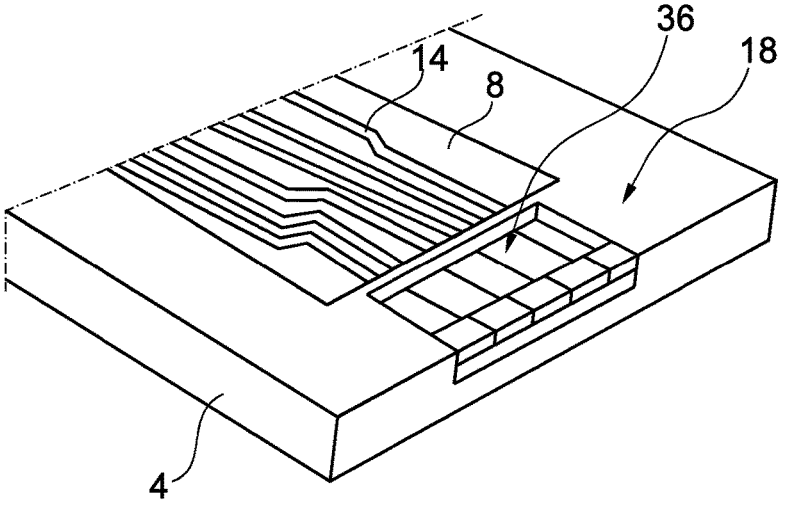

FIG. 10 furthermore indicates that the device 18 for producing a depression can also easily be adapted to other arrangements of conductor tracks 14. Here for example, a larger depression 36 is shown which is designed for a total of six conductor tracks 14. Evidently, this depiction is merely diagrammatic, and depression 36 may also be produced for significantly more or also fewer conductor tracks 14.

Figure 11:
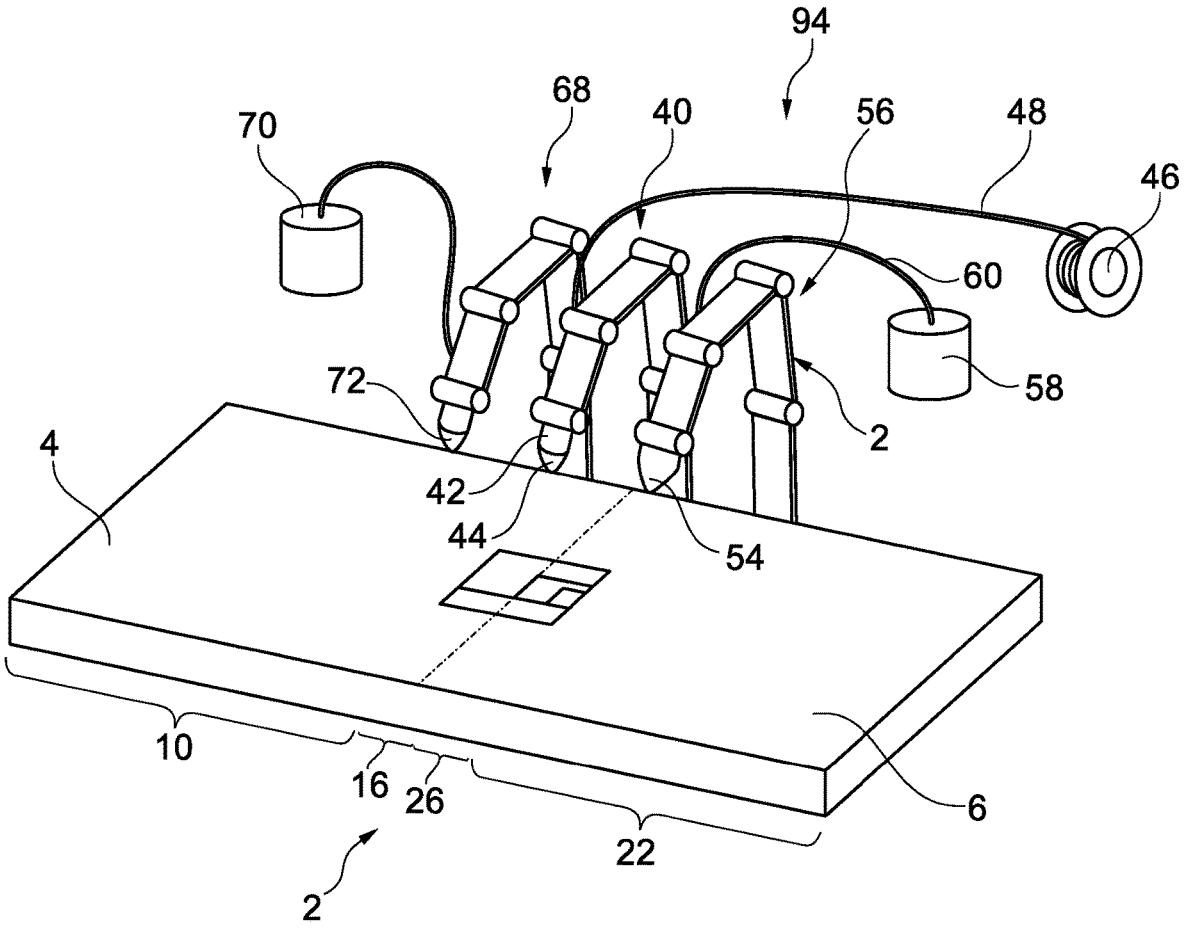
FIG. 11 shows a system for production of a line system.

FIG. 11 shows as an example that a system 94 may be used which may contain all three robot arms 40, 56 and 68, each with connected delivery heads and material stores. In this way, connectors and line systems can be produced very rapidly without the need for complex tool exchange.

Figure 12:
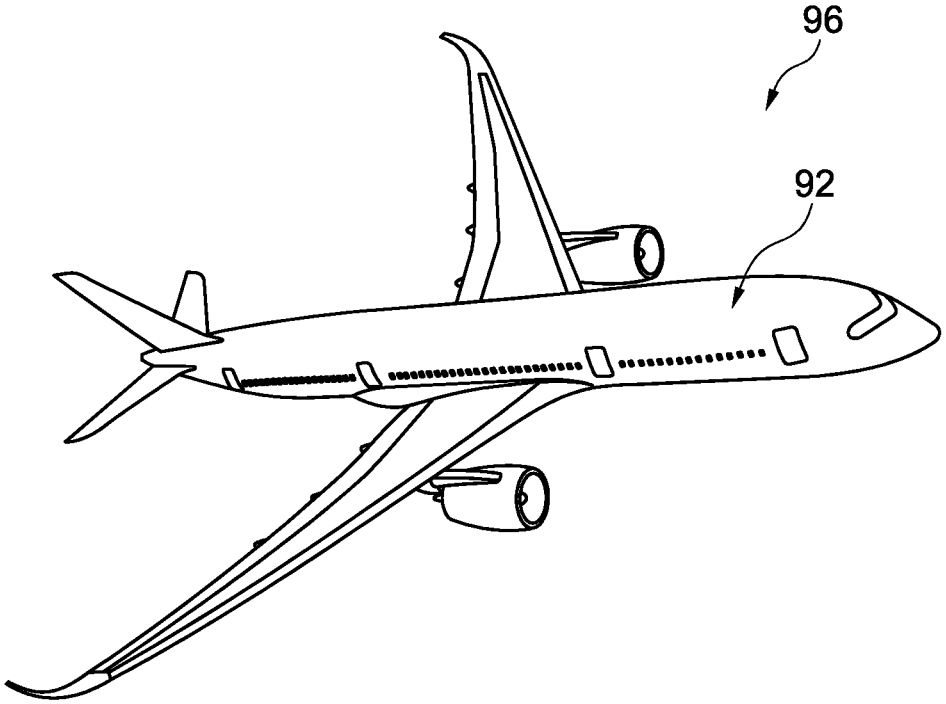
FIG. 12 shows an aircraft with a line system.

FIG. 12 furthermore shows an aircraft 96 which is equipped with at least one line system 92 on an equipment object (not shown).

In addition, it is pointed out that the term "comprising" does not exclude other elements or steps, and the terms "one" or "a" do not exclude a plurality. It is furthermore pointed out that features described with reference to one of the above-mentioned exemplary embodiments may also be used in combination with other features of other exemplary embodiments described above. Reference signs in the claims should not be regarded as a restriction.

While at least one exemplary embodiment of the present invention(s) is disclosed herein, it should be understood that modifications, substitutions and alternatives may be apparent to one of ordinary skill in the art and can be made without departing from the scope of this disclosure. This disclosure is intended to cover any adaptations or variations of the exemplary embodiment(s). In addition, in this disclosure, the terms "comprise" or "comprising" do not exclude other elements or steps, the terms "a" or "one" do not exclude a plural number, and the term "or" means either or both. Furthermore, characteristics or steps which have been described may also be used in combination with other characteristics or steps and in any order unless the disclosure or context suggests otherwise. This disclosure hereby incorporates by reference the complete disclosure of any patent or application from which it claims benefit or priority.

The invention claimed is:

1. A method for producing a connecting device for connecting films with conductor tracks, comprising:

laying a first film with a first arrangement of conductor tracks onto a first portion of a forming die;

applying a first lower shell of a plastic material onto a first end portion of the forming die adjoining the first portion;

producing a cut-out open towards the first end portion on the first film;

shifting the first film so that the cut-out lies completely on the first lower shell;

applying upper conductor tracks of a conductive material onto the first lower shell so that the upper conductor tracks overlap with the conductor tracks of the first film; and applying a first upper shell of a plastic material onto the first lower shell so that the first film, the first lower shell and the first upper shell connect together by substance bonding to form a first connector.

2. The method according to claim 1, further comprising:

laying a second film with a second arrangement of conductor tracks onto a second portion of the forming die;

applying a second lower shell of a plastic material onto a second end portion of the forming die adjoining the second portion;

producing a cut-out open towards the second end portion on the second film;

shifting the second film so that the cut-out lies completely on the second lower shell;

applying upper conductor tracks of a conductive material onto the second lower shell so that the upper conductor tracks overlap with the conductor tracks of the second film; and applying a second upper shell of a plastic material onto the second lower shell so that the second film, the second lower shell and the second upper shell connect together by substance bonding to form a second connector, which is formed so as to be complementary to the first connector such that the first connector and the second connector are configured to be connected together mechanically and electrically.

3. The method according to claim 1, wherein the applying of the lower shell and/or the upper shell step comprises performing an additive layer manufacturing process.

4. The method according to claim 1, wherein the cut-out has a smaller surface extension than the first lower shell.

5. The method according to claim 1, wherein the cut-out is formed to be rectangular and has a smaller width and smaller depth than the first lower shell.

6. The method according to claim 1, further comprising producing at least one opening with a contour which is spaced from edges of the first film.

7. The method according to claim 6, wherein the producing of at least one opening step comprises producing at least two openings which are adjacent to two mutually opposing edges of the cut-out.

8. The method according to claim 1, wherein the applying of upper conductor tracks step comprises performing an additive layer manufacturing process.

9. The method according to claim 1, wherein the applying of the lower shell and/or the upper shell step further comprises integrating at least one latching means.

10. The method according to claim 1, wherein the applying of upper conductor tracks step further comprises producing a contact portion to form a connection with another contact portion.

11. The method according to claim 1, wherein the first lower shell and the first upper shell form a protrusion at which the upper conductor tracks of the first film end.

12. The method according to claim 2, wherein the first lower shell and the first upper shell form a protrusion at which the upper conductor tracks of the first film end, and wherein the second lower shell and the second upper shell enclose a recess into which the protrusion is configured to be inserted and in which the upper conductor tracks of the second film end.

* * * * *